US006612549B1

(12) United States Patent
Woods, Jr.

(10) Patent No.: US 6,612,549 B1
(45) Date of Patent: Sep. 2, 2003

(54) HOIST APPARATUS

(76) Inventor: F. Lamar Woods, Jr., 335 Perkins Path P.O. Box 303, Jacksonboro, SC (US) 26452

( * ) Notice: Subject to any disclaimer, the term of this patent is extended or adjusted under 35 U.S.C. 154(b) by 0 days.

(21) Appl. No.: 10/014,205

(22) Filed: Nov. 9, 2001

(51) Int. Cl.[7] ..... B66D 1/00
(52) U.S. Cl. ..... 254/323
(58) Field of Search ..... 254/323, 325, 254/326, 327; 414/462, 540

(56) References Cited

U.S. PATENT DOCUMENTS

| | | | | | |
|---|---|---|---|---|---|
| D216,967 | S | | 3/1970 | Harden | |
| 4,614,252 | A | * | 9/1986 | Tarner | 182/116 |
| 5,393,194 | A | | 2/1995 | Smith | |
| 5,395,284 | A | | 3/1995 | Frisk | |
| 5,593,139 | A | | 1/1997 | Julian | |
| 5,662,451 | A | | 9/1997 | Muzzi et al. | |
| 5,765,917 | A | * | 6/1998 | Johnson | 297/352 |
| 5,876,019 | A | * | 3/1999 | Morrissey et al. | 254/323 |
| 5,975,831 | A | | 11/1999 | Martin | |
| 6,050,548 | A | * | 4/2000 | Leger | 254/326 |
| 6,138,991 | A | * | 10/2000 | Myers, Jr. | 254/323 |
| 6,155,771 | A | * | 12/2000 | Montz | 414/543 |
| 6,481,694 | B2 | * | 11/2002 | Kozak | 254/325 |
| 2001/0043852 | A1 | * | 11/2001 | Maxwell | 414/462 |
| 2002/0045417 | A1 | * | 4/2002 | Homer, Sr. | 452/189 |

* cited by examiner

*Primary Examiner*—Kathy Matecki
*Assistant Examiner*—Evan Langdon

(57) ABSTRACT

A hoist apparatus that is removably attachable to a cargo rack of an all-terrain vehicle for lifting large game and other objects for transport. The hoist apparatus includes a hoist bar having a hand winch attached to the outer end which is utilized to lift the large game or other objects. The opposite end of the hoist bar has a groove on the upper surface and a slotted end, both of which fit against the cargo rack. A support member in conjunction with a brace member are transversely coupled to the bottom surface of the hoist rack and rest against the outer portion of the cargo rack, thereby securing the apparatus to the vehicle.

14 Claims, 4 Drawing Sheets

HOIST APPARATUS

BACKGROUND OF THE INVENTION

1. Field of the Invention

The present invention relates to hoists and more particularly pertains to a new hoist apparatus that is removably attachable to a cargo rack of an all-terrain vehicle for lifting large game and other objects for transport.

2. Description of the Prior Art

The use of hoists is known in the prior art. U.S. Pat. No. 5,662,451 describes a device for lifting large game through a series of pulleys, all of which is couplable to an ATV. Another type of hoists is U.S. Pat. No. 5,393,194 having a pivotable boom with a pulley arrangement that utilizes an electric winch to elevate large game off the ground.

While these devices fulfill their respective, particular objectives and requirements, the need remains for a device that has certain improved features including a simplified frame and hoist design.

SUMMARY OF THE INVENTION

The present invention meets the needs presented above by having a simple, three-piece frame that requires no mounting hardware, and a powerful hand winch mounted to the end of the main boom member for lifting.

Still yet another object of the present invention is to provide a new hoist apparatus that is lightweight due to the simplistic frame design, thereby making the device easy to handle and transport.

Even still another object of the present invention is to provide a new hoist apparatus that can literally be set onto the cargo rack of the ATV and utilized without cumbersome, time-consuming mounting devices.

To this, the present invention generally comprises a hoist bar having a hand winch attached to the outer end which is utilized to lift the large game or other objects. The opposite end of the hoist bar has a groove on the upper surface and a slotted end, both of which fit against the cargo rack. A support member in conjunction with a brace member are transversely coupled to the bottom surface of the hoist rack and rest against the outer portion of the cargo rack, thereby securing the apparatus to the vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
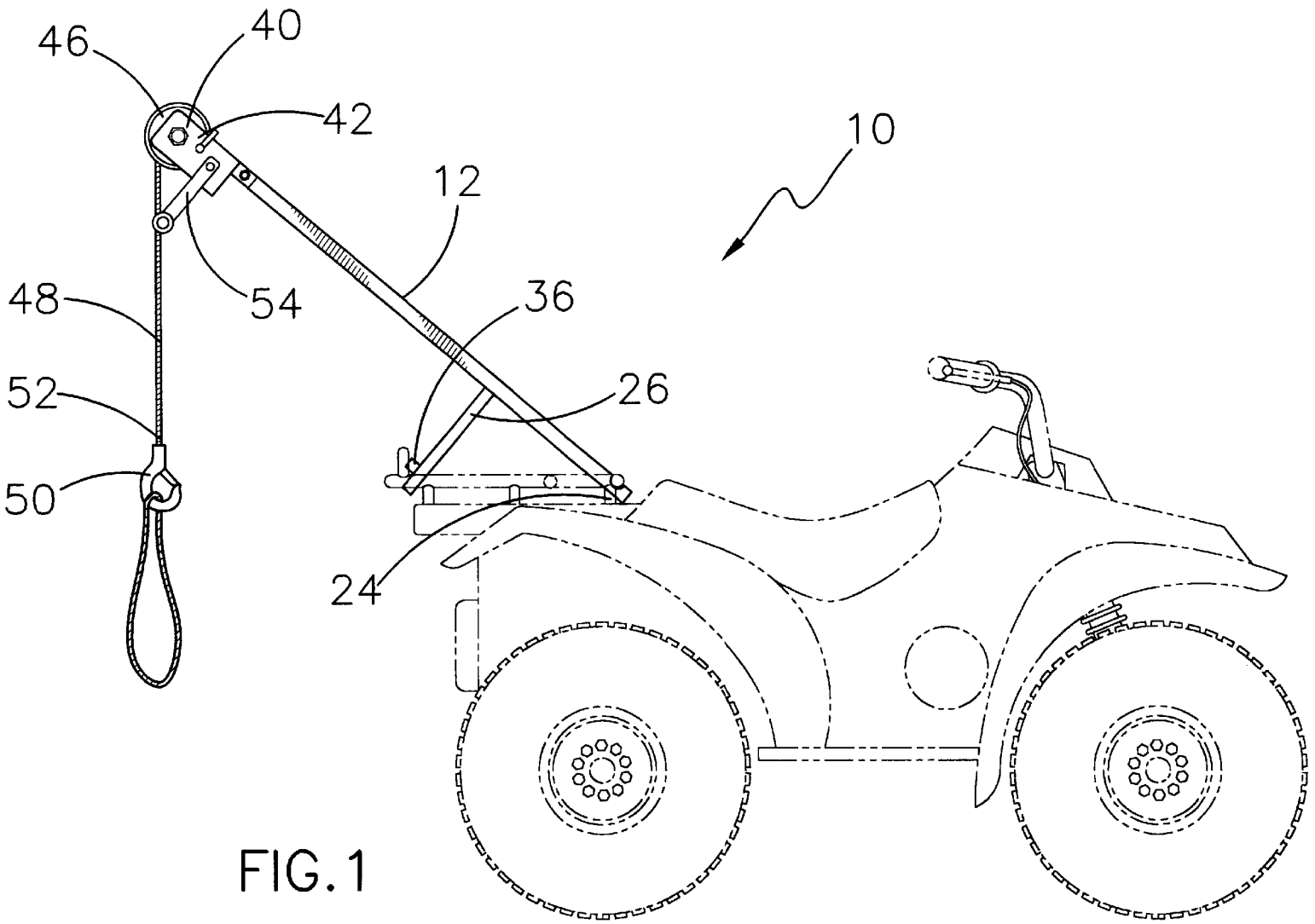
FIG. 1 is a schematic side view of a new hoist apparatus according to the present invention.
Figure 2:
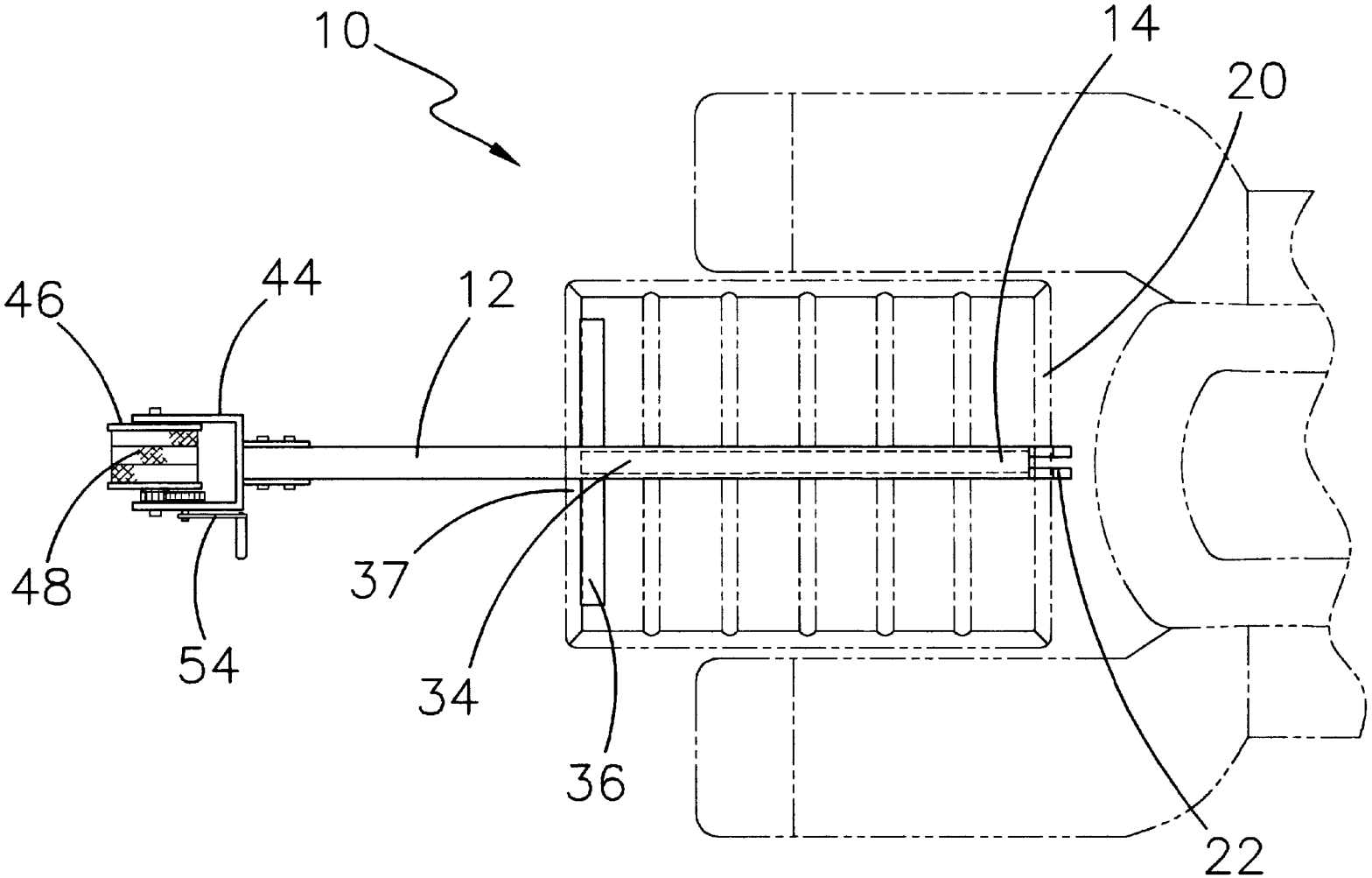
FIG. 2 is a schematic top view of the present invention.
Figure 3:
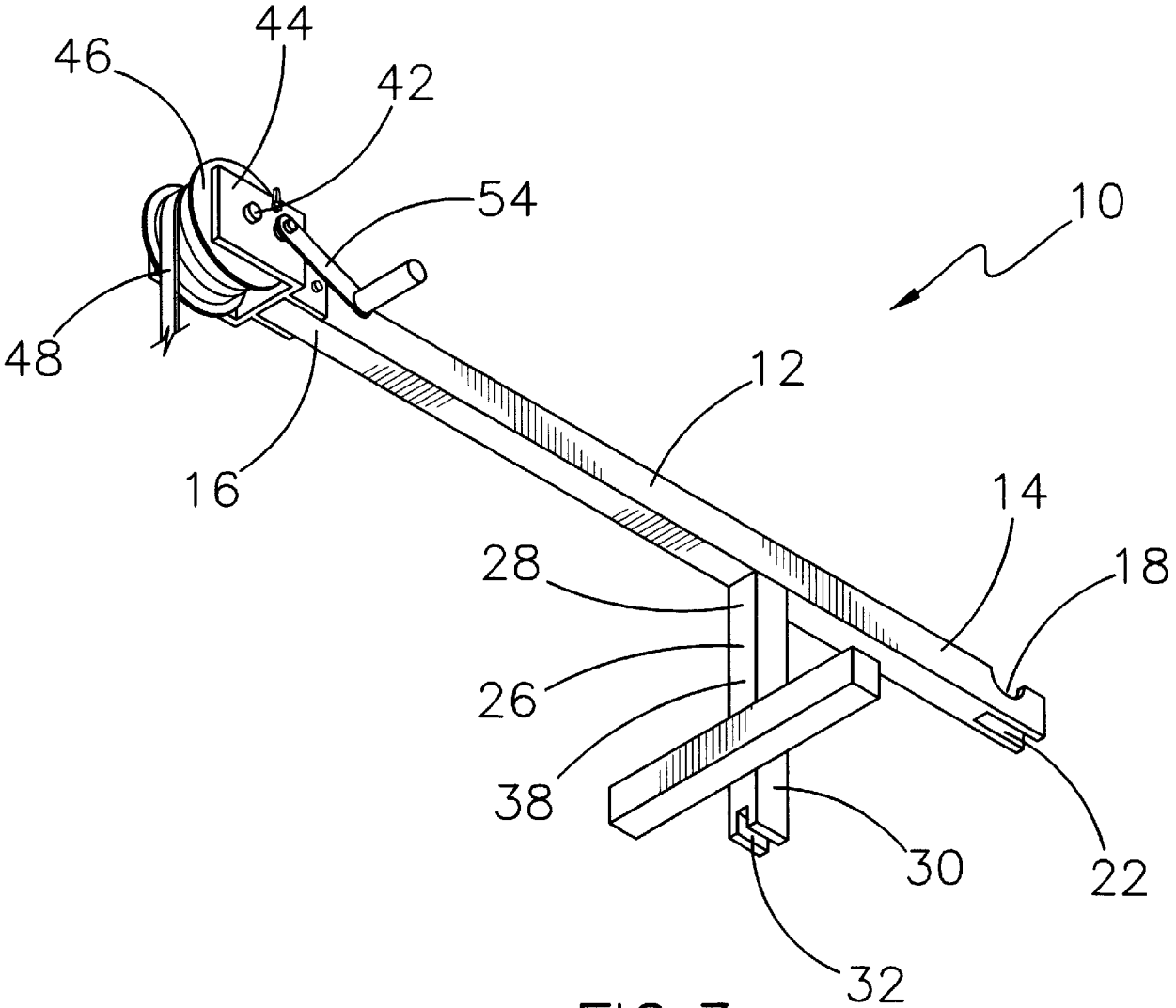
FIG. 3 is a schematic perspective view of the present invention.
Figure 4:
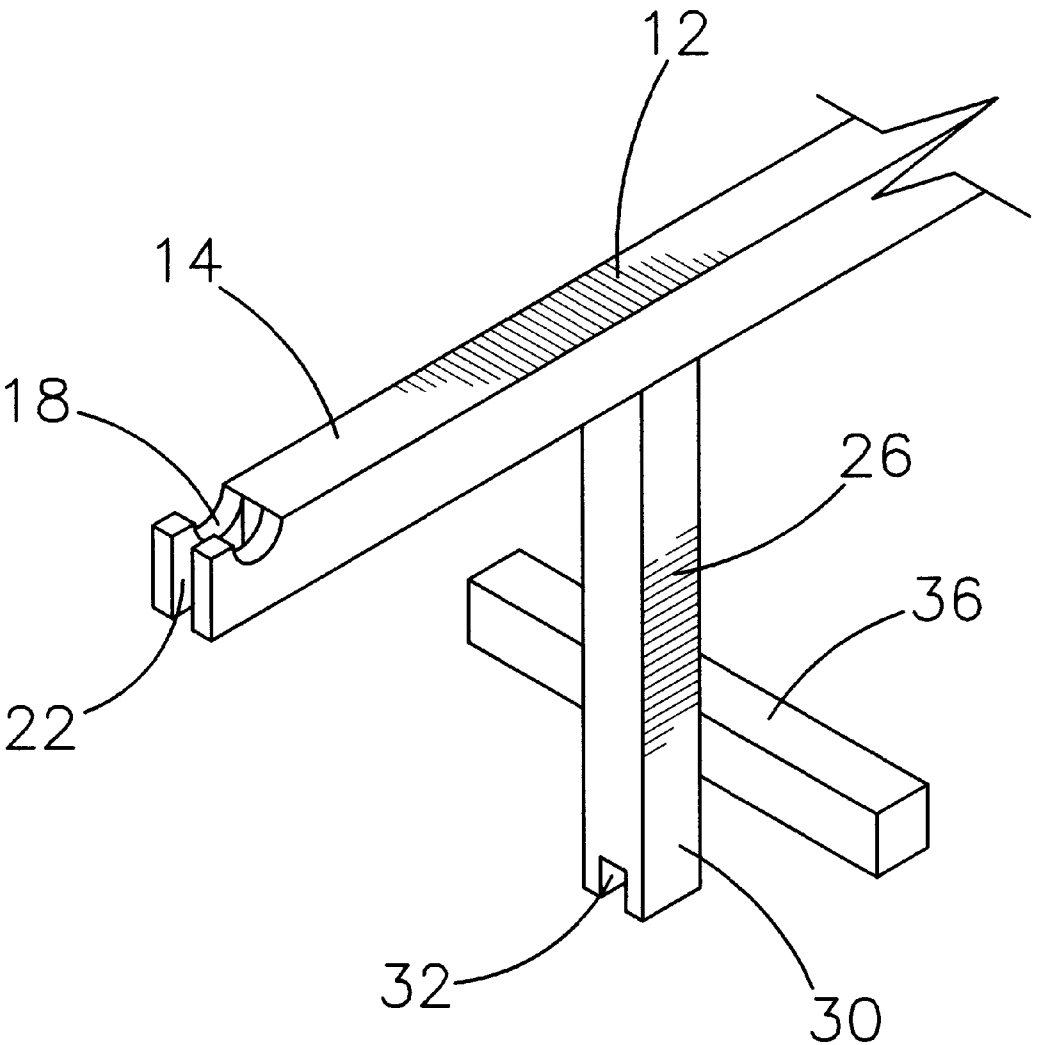
FIG. 4 is a schematic perspective view of the bracing section of the present invention.

With reference now to the drawings, and in particular to FIGS. 1 through 4 thereof, a new hoist apparatus embodying the principles and concepts of the present invention and generally designated by the reference numeral 10 will be described.

As best illustrated in FIGS. 1 through 4, the hoist apparatus 10 generally comprises a hoist bar 12 that is elongate and has a first end 14 and a second end 16. The hoist bar 12 has a groove 18 therein positioned generally adjacent to the first end 14.

The groove 18 has a radius substantially equal to a radius of an inner horizontal rack bar 20 such that the groove 18 is for receiving the inner horizontal rack bar 20. The inner horizontal rack bar 20 is oriented substantially perpendicular to a longitudinal axis of the hoist bar 12.

The first end 14 has a slot 22 for receiving one of the vertical bars 24.

Also included is a support member 26 for supporting the hoist bar 12. The support member 26 is elongate and has an upper end 28 attached to the hoist bar 12 nearer to the first end 14. The support member 26 is oriented substantially perpendicular to the hoist bar 12. A lower end 30 of the support member 26 has a channel 32 for receiving a center horizontal rack bar 34.

A brace member 36 abuts an outer horizontal rack bar 37 when the support member 26 is contacting the center horizontal rack bar 34. The brace member 36 is elongate and is fixedly coupled to the support member 26 proximate the second end 16 on a rear surface 38 of the support member 26, wherein the rear surface 38 faces the second end 16. The brace member 36 is oriented generally perpendicular to the support member 26 and extends away from the support member 26 in opposite directions.

A lifting means 40 is attached to the second end 16. The lifting means 40 includes a winch 42 that has a frame 44 for securing a drum member 46.

A cable member 48 for attaching to the objects to be lifted is wound around the drum member 46.

An attaching member 50 attaches the cable member to the objects and is coupled to a free end 52 of the cable member.

The winch 42 includes a crank 54 for facilitating rotation of the drum member 46 thereby vertically maneuvering the attaching member.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hoist apparatus for lifting an object, the apparatus being removably attached to a cargo rack of an all-terrain vehicle, the rack comprising a plurality of horizontal rack bars mounted on vertical bars and is attached to a front or rear section of the vehicle, said apparatus comprising:

a hoist bar being elongate and having a first end and a second end;

a support member being coupled to said hoist bar such that said support member extends away from said hoist bar between said first end and said second end of said hoist bar, said support member being for supporting said hoist bar from that rack of the all-terrain vehicle;

a brace member for abutting an outer horizontal rack bar when said support member is contacting a center horizontal rack bar;

a lifting means being attached to said second end;

said hoist bar having a groove therein positioned adjacent to said first end of said hoist bar, said groove being for receiving an inner horizontal rack bar; and said first end of said hoist bar having a slot for receiving one of the vertical rack bars, said slot having a longitudinal axis being positioned perpendicular to a longitudinal axis of said groove of said hoist bar, said slot extending into said groove of said hoist bar such that said slot is adapted for permitting said hoist bar to be selectively mounted to the inner horizontal rack bar and positioned around one of the vertical rack bars to inhibit sliding of said hoist bar with respect to the rack of the all-terrain vehicle.

2. The hoist apparatus as set forth in claim 1, wherein the inner horizontal rack bar is oriented perpendicular to a longitudinal axis of said hoist bar.

3. The hoist apparatus as set forth in claim 1, wherein said groove having a radius equal to a radius of the inner horizontal rack bar.

4. The hoist apparatus as set forth in claim 1, wherein said support member being elongate and having an upper end attached to said hoist bar nearer to said first end.

5. The hoist apparatus as set forth in claim 1, wherein said support member being oriented perpendicular to said hoist bar.

6. The hoist apparatus as set forth in claim 1, further comprising a lower end of said support member having a channel for receiving the center horizontal rack bar.

7. The hoist apparatus as set forth in claim 1, wherein said brace member being elongate.

8. The hoist apparatus as set forth in claim 6, wherein said brace member being fixedly coupled to said support member proximate said lower end on a rear surface of said support member, wherein said rear surface faces said second end.

9. The hoist apparatus as set forth in claim 1, wherein said brace member being oriented perpendicular to said support member such that said brace member extends away from said support member in opposite directions.

10. The hoist apparatus as set forth in claim 1, wherein said lifting means including a winch having a frame for securing a drum member.

11. The hoist apparatus as set forth in claim 10, further comprising a cable member for attaching to the objects to be lifted being wound around said drum member.

12. The hoist apparatus as set forth in claim 11, further comprising an attaching member for attaching said cable member to the objects, said attaching member being coupled to a free end of said cable member.

13. The hoist apparatus as set forth in claim 12, wherein said winch including a crank for facilitating rotation of said drum member thereby vertically maneuvering the attaching member.

14. A hoist apparatus for lifting an object, the apparatus being removably attached to a cargo rack of an all-terrain vehicle, the rack comprising a plurality of horizontal rack bars mounted on vertical bars and is attached to a front or rear section of the vehicle, said apparatus comprising:

a hoist bar being elongate and having a first end and a second end, said hoist bar having a groove therein positioned adjacent to said first end, said groove being for receiving an inner horizontal rack bar, wherein the inner horizontal rack bar is oriented perpendicular to a longitudinal axis of said hoist bar, said groove having a radius equal to a radius of the inner horizontal rack bar, said first end having a slot for receiving one of said vertical bars, said slot having a longitudinal axis being positioned perpendicular to a longitudinal axis of said groove of said hoist bar, said slot extending into said groove of said hoist bar such that said slot is adapted for permitting said hoist bar to be selectively mounted to the inner horizontal rack bar and positioned around one of the vertical rack bars to inhibit sliding of said hoist bar with respect to the rack of the all-terrain vehicle;

a support member being coupled to said hoist bar such that said support member extends away from said hoist bar between said first end and said second end of said hoist bar, said support member being for supporting said hoist bar from that rack of the all-terrain vehicle, said support member being elongate and having an upper end attached to said hoist bar nearer to said first end, said support member being oriented perpendicular to said hoist bar, a lower end of said support member having a channel for receiving a center horizontal rack bar;

a brace member for abutting a horizontal rack bar when said support member is contacting the center horizontal rack bar, said brace member being elongate, said brace member being fixedly coupled to said support member proximate said lower end on a rear surface of said support member, wherein said rear surface faces said second end, said brace member being oriented perpendicular to said support member and extending away from said support member in opposite directions; and a lifting means being attached to said second end, said lifting means including a winch having a frame for securing a drum member, a cable member for attaching to the objects to be lifted being wound around said drum member, an attaching member for attaching said cable member to the objects being coupled to a free end of said cable member, said winch including a crank for facilitating rotation of said drum member thereby vertically maneuvering the attaching member.

* * * * *